United States Patent [19]

Hayes

[11] 4,407,557

[45] Oct. 4, 1983

[54] ELECTRICAL COUPLING DEVICE

[76] Inventor: Derek Hayes, Home Farm Cottage, St. Michael, Bungay, Suffolk NR 1NF, England

[21] Appl. No.: 283,235

[22] Filed: Jul. 14, 1981

[30] Foreign Application Priority Data

Jul. 16, 1980 [GB] United Kingdom ..... 8023304

[51] Int. Cl.[3] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,184,704 | 5/1965 | Raymond et al. | 339/97 R |
| 3,218,597 | 11/1965 | Oehlerking et al. | 339/98 UX |
| 4,080,034 | 3/1978 | Werner | 339/98 |
| 4,148,540 | 4/1979 | Hayes | 339/99 R |
| 4,293,176 | 10/1981 | Lindlof | 339/98 |

FOREIGN PATENT DOCUMENTS

| | | | |
|---|---|---|---|
| 192890 | 11/1964 | Switzerland | 339/99 R |

*Primary Examiner*—Howard N. Goldberg
*Attorney, Agent, or Firm*—Howson and Howson

[57] ABSTRACT

An electrical coupling device, for example an electric plug, for effecting electrical connection between an electrically-conducting member of the coupling device and the electrically-conducting material of an insulated electrical conductor, comprises a base member, a cradle provided on the base member and having an internal space for the reception of said conductor, which space is defined between a pair of spaced-apart confronting surfaces of the cradle between which, in use of the coupling device, the conductor is held, and a metallic, conductor-piercing means, forming at least a part of said electrically-conducting member, which projects into said space between said confronting surfaces, whereby when the conductor is introduced into said space, the conductor-piercing means penetrates the electrically-insulating material of the conductor and makes contact with the electrically-conducting material of the conductor while the conductor is held between said confronting surfaces. The cradle, which may be formed integrally with the conductor-piercing means, may be arranged to displace insulating material from the conductor during insertion of the conductor into the cradle so that, in the inserted position of the conductor, said confronting surfaces bear substantially directly on the conducting material of the insulated conductor.

13 Claims, 12 Drawing Figures

ELECTRICAL COUPLING DEVICE

Figure 1:
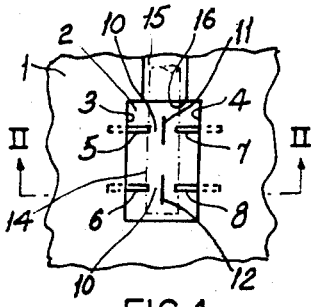

This invention relates to an electrical coupling device, and in particular, but not exclusively, it relates to a 3-pin, 13 amp fused plug.

In my U.S. Pat. No. 4,148,540, dated Apr. 10, 1979, there is described an electrical coupling device comprising a body portion having an electrically-insulating part with a recess in its surface, and electrically-conducting metallic piercing means mounted in said recess and extending generally in the direction of a pair of opposed sides of the recess but laterally spaced therefrom, and conductor-locating means comprising a pair of cooperating jaws movable relative to each other and having first mutually confronting surfaces configured to receive between them and locate an insulated electrical conductor when said jaws are urged towards one another, at least one end of said pair of jaws being configured to enter into said recess and to allow entry of said piercing means between the jaws and piercing of said conductor by said piercing means when said one end of the jaws is advanced into said recess, the outer surfaces of said pair of jaws and said opposed surfaces of said recess being configured to produce a camming action such that advancing said jaws into said recess urges the jaws towards one another to locate said conductor at least during the piercing of the conductor by the piercing means.

I have now found that a conductor-locating means other than said pair of cooperating jaws may be employed in coupling devices of the above-mentioned kind.

According to the present invention, an electrical coupling device for effecting electrical connection between an electrically-conducting member of the coupling device and the electrically-conducting material of an insulated electrical conductor, comprises a base member, a cradle provided on the base member, said cradle having an internal space for the reception of said conductor, which space is defined between a pair of spaced-apart confronting surfaces of the cradle between which, in use of the coupling device, the conductor is held, and a metallic, conductor-piercing means, forming at least part of said electrically-conducting member, which projects into said space between said confronting surfaces, whereby when said conductor is introduced into said space, said conductor-piercing means penetrates the electrically-insulating material of the conductor and makes contact with the electrically-conducting material of the conductor while the conductor is held between said confronting surfaces.

Said confronting surfaces of the cradle may be arranged to displace insulating material from the conductor during insertion of the conductor into the cradle so that, in the inserted position of the conductor, said confronting surfaces bear substantially directly on the conducting material of the insulated conductor. For example, said confronting surfaces may be provided with ribs or other projections which displace insulating material from localised regions of the conductor as it is inserted into the cradle. Preferably, the insulation-displacing rib(s) or projection(s) on one of said confronting surfaces is (or are) opposite the insulation-displacing rib(s) or projection(s) on the other of said confronting surfaces, and said piercing means is located either in the region or regions between opposed rib(s) or projection(s) of the two confronting surfaces or closely adjacent to said region or regions.

The metallic piercing means may form the metallic member with which it is desired to make electrical connection in the coupling device. In this case the coupling device may serve to provide electrical connection between two insulated electrical conductors, both of which would be inserted into said cradle, one after the other, to be pierced by said piercing means, so that the latter provides the connection between the two conductors.

Alternatively, the metallic piercing means may be joined to a metallic member, for example a pin of an electric plug, to which it is desired to connect the conductor.

In a first embodiment of a coupling device in accordance with the invention, said metallic piercing means, as in the case of the coupling devices described in U.S. Pat. No. 4,148,540, may be mounted in a recess in a base member, so that it extends generally in the direction of a pair of opposed sides of the recess but laterally spaced therefrom. In this case, said pair of opposed sides of the recess forms said cradle, and these sides of the recess may be provided with one or more ribs projecting from said sides and disposed substantially parallel to the metallic piercing means. If, as in the case of the coupling devices described in U.S. Pat. No. 4,148,540, said base member is made of electrically-insulating plastics material, said ribs may be moulded integrally with the opposed sides of said recess. Alternatively, said ribs may be provided by strips of metallic material mounted in said opposed sides of the recess.

In this first embodiment of the coupling device in accordance with the invention, the recess in the base member may be formed in the same way as described in U.S. Pat. No. 4,148,540, or between a pair of spaced-apart pillars formed on, for example moulded integrally with, the base member.

In another embodiment of a coupling device in accordance with the invention, said cradle may be made entirely of metallic material and may be mounted on a base of electrically-insulating material. For example, the cradle may be located in a recess in the base member or be simply secured to the base member.

An electrical coupling device in accordance with the invention may take the form of an electric plug, said base member then being made of electrically-insulating material and carrying at least one metallic contact pin to which said metallic conductor-piercing means is electrically connected. In one embodiment of such a plug, said cradle may be provided by a pair of opposed walls of a recess formed in the base member. Alternatively, said cradle may be formed integrally with, or be physically secured to, said pin. Although such a plug may have a single contact pin or two contact pins, the main interest of this aspect of the invention lies in the field of 3-pin plugs, in particular 3-pin, 13 amp fused plugs. The plug may be of the rewirable kind, but it is at present considered that the kind of connection provided by a plug in accordance with this aspect of the invention would be more suitably effected in a factory-assembled plug of the non-rewirable kind.

Figure 2:
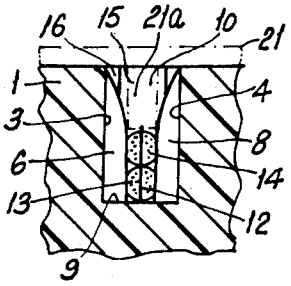
Figure 3:
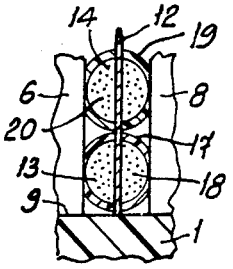
Figure 4:
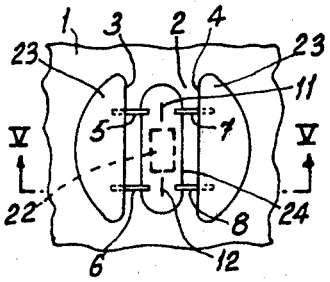
Figure 5:
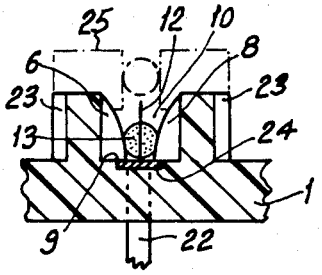
Figure 8:
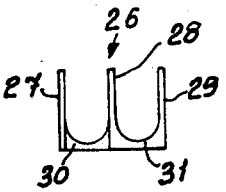
Figure 6:
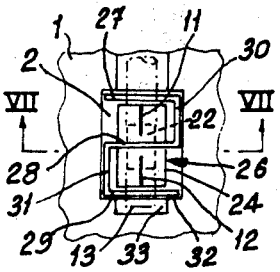
Figure 7:
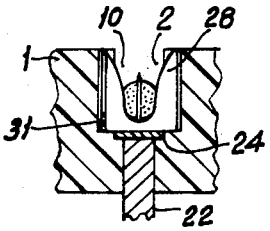
Figure 11:
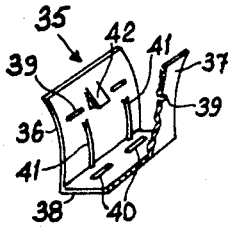
Figure 9:
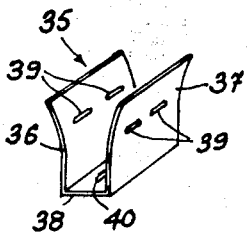
Figure 10:
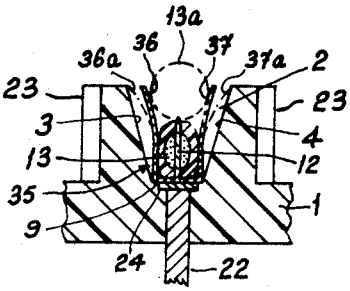
Figure 12:
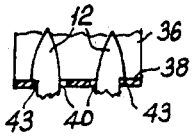

The invention will now be described, by way of example, with reference to the accompanying drawing, in which FIG. 1 is a plan of part of a first embodiment of an electrical coupling device in accordance with the invention, FIG. 2 is a sectional view taken on the line II—II of FIG. 1, FIG. 3 is a view on an enlarged scale of a part of FIG. 2, FIGS. 4 and 5 are views similar to FIGS. 1 and 2, respectively, of part of a second embodiment of an electrical coupling device in accordance with the invention, FIG. 5 being a section taken on the line V—V of FIG. 4, FIGS. 6 and 7 are views similar to FIGS. 1 and 2, respectively, of part of a third embodiment of an electrical coupling device in accordance with the invention, FIG. 7 being a section taken on the line VII—VII of FIG. 6, FIG. 8 is a side view of the cradle of the coupling device of FIGS. 6 and 7, FIG. 9 is a perspective view of the cradle of a fourth embodiment of an electrical coupling device in accordance with the invention, FIG. 10 is a sectional view of part of an electrical coupling device employing the cradle of FIG. 9, FIG. 11 is a view similar to FIG. 9 of part of the cradle of a fifth embodiment of an electrical coupling device in accordance with the invention, and FIG. 12 is a sectional side view of the cradle of FIG. 11 showing its engagement with conductor piercing blades.

The coupling device shown in FIGS. 1 to 3 comprises a block 1 of electrically-insulating material in which there is a recess 2 with opposed, parallel side walls 3, 4. Two spaced-apart, parallel, metallic strips 5,6, for example of brass, are secured in, and project from, the side wall 3 and two spaced-apart, parallel, metallic strips 7, 8 are secured in, and project from, the side wall 4. These strips 5–8 may be partially embedded in their associated side walls 3 and 4, or they may be mounted in slots in these side walls. The plane of each of the strips 5–8 is disposed at right angles to its respective side wall 3 or 4, and the strips are disposed so that an edge of the strip 5 is opposite an edge of the strip 7 and an edge of the strip 6 is opposite an edge of the strip 8. The strips 5–8 are wider towards the bottom 9 of the recess 2 than at the top of the latter, so that the gap 10 between confronting edges of opposed pair of strips decreases in width in the direction towards the bottom 9.

Secured in, and projecting upwardly from, the bottom 9 of the recess 2 between and parallel to the side walls 3, 4 are two metallic blades 11, 12, the blade 11 being disposed in the middle of the gap 10 between the confronting edges of the strips 5 and 7 and the blade 12 being disposed in the middle of the gap 10 between the confronting edges of the strips 6 and 8.

The coupling device of FIGS. 1 to 3 is employed to provide an electrical connection between two insulated conductors 13 and 14. As shown in FIG. 2, the first conductor 13 is pushed down into the recess 2, between the pairs of strips 5 and 7 and 6 and 8, into a position where it lies close to, and substantially parallel to, the bottom 9 of the recess, an aperture 15 in one end wall 16 of the recess allowing the conductor 13 to take up this position. As the conductor is pushed down into the recess 2, the blades 11, 12 penetrate the conductor, and pass through the insulating sheath 17 (see FIG. 3) and the conducting portion 18 of the conductor. At the same time, the confronting edges of the strips 5 and 7 and the confronting edges of the strips 6 and 8 displace at least part of the insulating sheath 17 from the conductor, as shown for the pair of strips 6 and 8 in FIG. 3. As a result, the confronting edges of the strips 5–8 bear on the conducting portion 18 of the conductor 13 either directly or through only a very thin residual layer of insulating material. The conducting portion 18 is therefore firmly held between the confronting edges of the strips 5–8 and makes good electrical contact with the blades 11 and 12.

The second conductor 14 is then pressed down into the recess 2 in the same way until it rests on top of the conductor 13, as shown in FIGS. 2 and 3, the conductor 14 then occupying the position shown in chain lines in FIG. 1 where it passes out from the block 1 through the aperture 15. Again, the confronting edges of the strips 5–8 displace at least part of the insulating sheath 19 of the conductor 14 (see FIG. 3) so that the conducting portion 20 of the conductor is firmly held between the strips and makes good electrical contact with the blades 11 and 12.

When the two conductors 13 and 14 have been pressed down into the recess 2 as described above, the two blades 11 and 12 provide effective electrical connections between the conducting portions of the two conductors. When the connection has been completed, a cover 21, shown in chain lines in FIG. 2, may be secured to the block 1 over the open top of the recess 2. This cover may be removably mounted on the block 1 if the coupling device is intended to be of the rewirable type. If, however, the coupling device is intended to be of the non-rewirable type, the cover 21 may be permanently secured to the block 1, for example moulded onto the block. Whether the cover is removably or permanently mounted on the block 1, it may comprise a projection 21*a* which enters the recess 2 to prevent the conductors 13 and 14 from rising in the recess. In the case of a cover 21 which is slid onto the base 1, for example as disclosed in British patent specification No. 833,222, the underside of the cover may be shaped so that it engages the conductor 14 and forces it down into the gaps 10 as the cover is slid into its position of securement on the base 1.

It will be appreciated that, by suitable shaping of the confronting edges of the strips 5–8, the coupling device of FIGS. 1 to 3 may be employed for connecting together conductors in a range of sizes.

FIGS. 4 and 5 show part of a coupling device in the form of an electric plug for connecting an insulated conductor 13 to a pin 22 of the device. This coupling device is similar in many respects to the device shown in FIGS. 1 to 3, and like parts in the two devices have been designated with the same reference numerals. The device of FIGS. 4 and 5 again comprises a block 1 of electrically-insulating material, which in this case forms the base of the plug from which the pin 22 projects. In this case, the recess 2 of the block is formed between two pillars 23 moulded integrally with the block, these pillars having spaced-apart, confronting walls 3, 4 corresponding to the side walls 3, 4 of the recess 2 of FIGS. 1 and 2. Metallic strips 5–8 are fixed to, and project from the walls 3, 4, as in the case of the device of FIGS. 1 to 3, and blades 11 and 12 project upwardly from the bottom 9 of the recess 2 in the middle of the gaps 10 between confronting edges of the strips 5 and 7 and the strips 6 and 8. In this embodiment, however, the blades 11, 12 are secured to a plate 24 of metallic material which is joined to, or formed integrally with, the pin 22.

In the embodiment of FIGS. 4 and 5, the recess has been shown considerably shallower than the recess 2 of the device of FIGS. 1 and 2, and the tips of the blades 11 and 12 are close to the open top of the recess. In such cases, it is desirable to guide the conductor 13 as it is entered into the recess 2, to ensure that the blades 11, 12 pass centrally through the conductor 13. Such guidance may be provided by a jig 25, shown in chain lines in FIG. 5, which is temporarily positioned over the recess 2. It will, of course, be appreciated that a shallower recess 2 may be employed in the embodiment of FIGS. 1 and 2, and that a deeper recess 2 may be employed in the embodiment of FIGS. 4 and 5.

The strips 5–8 in the embodiment of FIGS. 4 and 5 serve the same purpose as the corresponding strips in the device of FIGS. 1 to 3, i.e. they displace part of the insulating sheath of the conductor 13 as the latter is pressed down into the tapered gap 10 between confronting edges of the strips. By suitably shaping these confronting edges, the device can be arranged to accept conductors in a range of different sizes.

As in the case of the embodiment of FIGS. 1 to 3, a cover (not shown) may be removably or permanently fixed over the block 1 when the conductor 13 has been pressed into the recess 2.

In the embodiments of FIGS. 1 to 5, the strips 5–8 are all separate from one another. In modified forms of these embodiments, the strips 5 and 6 and the strips 7 and 8, or the strips 5 and 7 and the strips 6 and 8 may be combined in pairs which are partially embedded in, or otherwise secured to the walls 3, 4 of the recess 2. Again, all four of the strips 5–8 may be combined into a single unit which can be loosely mounted in the recess 2. In these modified forms, the strip units may be formed integrally with the blades 11, 12, and in the case of coupling devices with pins, the strip units, blades and pins may be integral with one another.

FIGS. 6 to 8 show part of a coupling device in the form of an electric plug for connecting a conductor 13 to a pin 22 of the device. Again, this coupling device is similar in certain respects to the previously described embodiments, and parts in the embodiment of FIGS. 6 to 8 which are substantially the same as in the previous embodiments have been designated with the same reference numerals as in FIGS. 1 to 5.

In the embodiments of FIGS. 1 to 5, the cradle which receives the conductor 13 (or conductors 13 and 14), which is formed by the side walls 3, 4 of the recess 2 and the strips 5–8, is fixed relative to the blades 11, 12. This is not the case in the embodiment of FIGS. 6 to 8, in which the conductor-receiving cradle, generally designated by the numeral 26, is removably housed in the recess 2 of the block 1.

The cradle 26 has three spaced-apart, parallel limbs 27, 28 and 29, joined together by webs 30 and 31, so that the cradle has approximately the shape of a figure "2" as viewed from above (see FIG. 6). Each of the limbs 27–29 has a tapered gap 10 formed therein, as can be seen for the limb 28 in FIG. 7, and the webs 30 and 31 have the shape shown in FIG. 8. As in the case of the embodiment of FIGS. 4 and 5, the coupling device of FIGS. 6 to 8 has its conductor-piercing blades 11 and 12 projecting upwardly in the recess 2 from a metallic plate 24 which is joined to, or formed integrally with, the pin 22. It will be noted, however, that in this embodiment, the blades 11, 12 are not located in the gaps 10 of the limbs 27–29, but the blade 11 is located between the limbs 27 and 28 and the blade 12 is located between the limbs 28 and 29.

The device of FIGS. 6 to 8 is employed in the same way as the device of FIGS. 4 and 5 for connecting a conductor 13 to the pin 22. From FIG. 6 it will be seen that the end wall 32 of the recess 2 is provided with a recess 33 to accommodate the free end of the conductor 13.

As in the case of the previous embodiments, the block 1 may be provided with a cover (not shown) over the open top of the recess 2.

In a modified form of the coupling device of FIGS. 6 to 8, the cradle 26 is formed integrally with, or joined to, the pin 22. In this case, it may not be necessary to locate the cradle 26 in a recess in the block 1.

FIGS. 9 and 10 show part of another coupling device, in the form of an electric plug, for connecting a conductor 13 to a pin 22 of the device. This coupling device is similar in certain respects to the embodiment described above with reference to FIGS. 4 and 5, and parts in the embodiment of FIGS. 9 and 10 which are substantially the same as in the embodiment of FIGS. 4 and 5 have been the same as in the embodiment of FIGS. 4 and 5 have been designated with the same reference numerals.

The device of FIGS. 9 and 10 again comprises a block 1 of electrically-insulating material which forms the base of the plug from which the pin 22 projects. A recess 2 is again formed in the block 1 between two spaced-apart pillars 23 forming an integrally moulded part of the block 1. The confronting walls 3, 4 of these pillars converge towards one another in the direction towards the bottom 9 of the recess. Conductor-piercing blades, similar to the blades 11, 12 in FIGS. 4 and 5, project upwardly from the bottom 9 of the recess 2, one of these blades, designated by the numeral 12, being shown in FIG. 10. These blades are again secured to a plate 24 of metallic material which is joined to, or formed integrally with, the pin 22.

A cradle generally designated by the numeral 35, is received in the recess 2. This cradle, shown in perspective in FIG. 9, is made from metallic sheet material and is of generally U-shape with two limbs 36, 37 connected by a web 38. The limbs 36 and 37 flare outwardly at their free ends, and each of the limbs is provided with slits 39, disposed parallel to the web 38 and positioned approximately mid-way between the web 38 and the free ends of the limbs 36, 37. The web 38 is provided with a pair of spaced-apart slits 40, only one of which can be seen in FIG. 9. When the cradle 35 is placed in the recess 2, the blades 12 pass through the slits 40 and the blades locate the cradle in the longitudinal direction of the web 38. When the cradle is fully inserted into the recess 2, its web 38 is located in the transverse direction of the web at the corners between the bottom 9 of the recess 2 and the walls 3, 4 thereof.

When the conductor 13 is to be connected with the piercing blades 12, it is first placed in the position indicated by the chain line 13*a* in FIG. 10. It is then forced down between the limbs 36, 37 and the latter are forced outwardly, by bending in the region of the slits 39, to the positions 36*a*, 37*a*, shown in chain lines in FIG. 10. The cradle 35 is then accurately centred in the recess 2, so that, as the conductor is pressed down to the bottom of the cradle, the piercing blades 12 pass through the centre of the conductor. When the conductor 13 is fully inserted into the cradle 35, the limbs 36, 37 reassert themselves and return to the positions shown in full lines in FIG. 10. In the fully inserted position of the conductor 13, it is firmly held between the limbs 36, 37, close to the web 38, and the conducting portion of the conductor makes good electrical contact with the piercing blades 12. Any subsequent deterioration of the plastics material of the block 1 will not affect this firm hold on the conductor 13.

As in the case of the previous embodiments, the block 1 may be provided with a cover (not shown) over the open top of the recess 2.

FIGS. 11 and 12 show a modified form of the cradle of FIG. 9, in which the internal confronting surfaces of the limbs 36, 37 of the cradle 35 are provided with ribs 41 which serve to displace insulating material from the conductor 13 as it is pressed down into the cradle. In addition, each of the limbs 36, 37 is provided with an inwardly-projecting tongue 42, which may be stamped out of the material of the cradle. When a conductor is pressed down into the cradle, the limbs 36, 37 at first flex outwardly to allow the conductor to pass the tongues 42. When, however, the conductor has been fully pressed into the cradle, the limbs 35, 36 re-assert themselves and return to the positions shown in full lines in FIG. 10. The free ends of the tongues 42 then overlie the conductor and the latter cannot be removed from the cradle without damage being caused to the cradle, for example bending of the tongues 42 upwardly out of the way of the conductor.

FIG. 12 also shows how the piercing blades 12 are provided with shoulders 43 under which the web 38 of the cradle engages when the cradle is placed in the recess 2, this positioning of the cradle being allowed by slight inward flexing of the blades 12 towards one another as they pass through the slits 40 followed by springing apart of the blades 12. It will then be impossible to remove the cradle 35 from the recess 2 without causing damage to the cradle and/or the blades 12. It is a requirement in some countries that non-rewirable coupling devices should be made in such a manner that disconnection of the conductor from the coupling device cannot be achieved without permanent damage being caused to the coupling device. The above described tongues 42 and shoulders 43 are examples of two ways of satisfying this requirement.

Although the embodiments described above with reference to FIGS. 4 to 12 have a single pin 22, it will be appreciated that the invention includes coupling devices in the form of electric plugs comprising more than one pin and multi-pin fused plugs. In such plugs, each insulated conductor would be connected to its respective pin (or fuse clip) in the same way as the conductor 13.

What is claimed is:

1. An electrical coupling device for effecting electrical connection between an electrically-conducting member of the coupling device and the electrically-conducting material of an insulated electrical conductor, said coupling device comprising a base member of electrically insulating material, a cradle provided on the base member, said cradle including a pair of spaced-apart, metallic side members having respective first ends joined to each other by metallic connection means, said side members and said connection means together defining an internal space of the cradle which is open between respective second ends of said side members to enable said conductor, in use of the coupling device, to be pressed into said space between said side members, and a metallic, conductor-piercing means, forming at least part of said electrically-conducting member, which conductor-piercing means projects into said space between said side members in the direction from said first ends of said side members toward said second ends thereof, whereby when said conductor is introduced into said space, said conductor-piercing means penetrates the electrically-insulating material of the conductor to make contact with the electrically-conducting material of the conductor and the conductor is subjected to pressure between said side members of the cradle.

2. An electrical coupling device according to claim 1, wherein said cradle comprises means for displacing electrically-insulating material from said conductor during insertion of the conductor into the cradle.

3. An electrical coupling device according to claim 2, wherein said at least one of said side members of said cradle is provided with at least one projection which displaces electrically-insulating material from a localised region of the conductor as it is inserted into the cradle.

4. An electrical coupling device according to claim 3, wherein each of said side members of the cradle is provided with at least one of said projections, the or each projection on one of said side members being opposite a respective projection on the other of said side members.

5. An electrical coupling device according to claim 4, wherein said conductor-piercing means is located between opposed projections on the two side members of the cradle.

6. An electrical coupling device according to claim 1, 2 or 3, wherein said electrically-conducting member comprises a metallic pin mounted on said base member and electrically connected to said conductor-piercing means.

7. An electrical coupling device according to claim 6, wherein said pin is connected directly to said conductor-piercing means.

8. An electrical coupling device according to claim 7, wherein said pin is formed integrally with said conductor-piercing means, and said conductor-piercing means projects through said metallic connection means into said space.

9. An electrical coupling device according to claim 1, 2 or 3, wherein said cradle is located in a recess in said base member.

10. An electrical coupling device according to claim 9, wherein said recess is a hole in the base member.

11. An electrical coupling device according to claim 9, wherein said recess is formed between two spaced-apart pillars formed on the base member.

12. An electrical coupling device according to claim 9, comprising inter-engaging means between said cradle and said conductor-piercing means to prevent removal of said cradle from its location in said recess.

13. An electrical coupling device according to claim 1, 2 or 3, wherein said cradle comprises means for preventing removal of said conductor from said space.

* * * * *